US008973548B2

(12) United States Patent
Andreas

(10) Patent No.: US 8,973,548 B2
(45) Date of Patent: Mar. 10, 2015

(54) PISTON UPPER PART OF AN ASSEMBLED OR WELDED PISTON WITH EXTENDED COOLING SPACES

(75) Inventor: Olma Andreas, Lehrensteinsfeld (DE)

(73) Assignee: KS Kolbenschmidt GmbH (DE)

( * ) Notice: Subject to any disclaimer, the term of this patent is extended or adjusted under 35 U.S.C. 154(b) by 20 days.

(21) Appl. No.: 13/642,001

(22) PCT Filed: Feb. 2, 2011

(86) PCT No.: PCT/EP2011/000505

§ 371 (c)(1),
(2), (4) Date: Oct. 18, 2012

(87) PCT Pub. No.: WO2011/131266

PCT Pub. Date: Oct. 27, 2011

(65) Prior Publication Data

US 2013/0032104 A1 Feb. 7, 2013

(30) Foreign Application Priority Data

Apr. 19, 2010 (DE) ..... 10 2010 015 568

(51) Int. Cl.
*F02F 1/00* (2006.01)
*F01B 31/08* (2006.01)
(Continued)

(52) U.S. Cl.
CPC ..... *F02F 3/003* (2013.01); *B22C 9/105* (2013.01); *F02F 3/22* (2013.01); *F02F 3/225* (2013.01)
USPC ..... 123/193.2; 123/193.1; 123/193.6; 29/888.042; 29/888.044; 29/888.04; 92/216; 92/217; 92/218; 92/172; 92/186

(58) Field of Classification Search
CPC ..... B22D 19/0027; B22D 15/02; B22D 19/0009; B22C 9/105; F02F 2200/06; F02F 3/003; F02F 3/00; B23P 15/10; B21K 1/18
USPC ..... 123/41.35, 193.1, 193.6; 29/888.04, 29/888.042, 888.044; 92/216–221, 208, 92/172, 174
See application file for complete search history.

(56) References Cited

U.S. PATENT DOCUMENTS 3,613,521 A * 10/1971 Itano ..... 92/186
5,107,807 A * 4/1992 Arai et al. ..... 123/193.6
(Continued)

FOREIGN PATENT DOCUMENTS

DE 4118400 A1 1/1992
DE 19603589 A1 8/1997
(Continued)

OTHER PUBLICATIONS

International Search Report completed on Jun. 7, 2011 for PCT/EP2011/000505.
(Continued)

*Primary Examiner* — Marguerite McMahon
*Assistant Examiner* — Tea Holbrook
(74) *Attorney, Agent, or Firm* — Young Basile Hanlon & MacFarlane, P.C.

(57) ABSTRACT

A liquid cooled piston of an internal combustion engine includes a piston lower part and piston upper part which has a combustion chamber recess. These piston components are supported via joining lands which are spaced apart radially and together form a dividing plane, and are joined together with a material-to-material fit. In order to receive piston rings, the piston upper part has a ring area and includes an annular cooling channel which extends into the piston lower part and is connected to an inner cooling space via connecting channels. The cooling channel is adjoined by recesses which are oriented in the direction of a piston head, are configured as a blind hole and widen conically starting from the cooling channel as far as a recess bottom. The recess bottom can be of a pronounced undulating enlarged surface or a finely undulating configuration.

20 Claims, 5 Drawing Sheets

(51) Int. Cl.

| | |
|---|---|
| ***F02F 3/00*** | (2006.01) |
| ***B22C 9/10*** | (2006.01) |
| ***F02F 3/22*** | (2006.01) |

(56) References Cited

U.S. PATENT DOCUMENTS

| | | | | |
|---|---|---|---|---|
| 6,698,391 | B1 * | 3/2004 | Kemnitz | 123/193.6 |
| 7,356,925 | B2 * | 4/2008 | Bubeck | 29/888.074 |
| 8,240,039 | B2 * | 8/2012 | Kondoh et al. | 29/888.04 |
| 8,485,088 | B2 * | 7/2013 | Feeser | 92/186 |
| 2003/0188633 | A1 * | 10/2003 | Griffiths et al. | 92/208 |
| 2004/0055460 | A1 * | 3/2004 | Kohnert | 92/185 |
| 2008/0121102 | A1 * | 5/2008 | Scharp et al. | 92/208 |
| 2009/0025550 | A1 * | 1/2009 | Benz et al. | 92/186 |
| 2010/0108017 | A1 * | 5/2010 | Bing et al. | 123/193.6 |

FOREIGN PATENT DOCUMENTS

| | | | |
|---|---|---|---|
| DE | 10244512 | A1 | 4/2004 |
| GB | 2349195 | A | 10/2000 |

OTHER PUBLICATIONS

Written Opinion for PCT/EP2011/000505.

* cited by examiner

PISTON UPPER PART OF AN ASSEMBLED OR WELDED PISTON WITH EXTENDED COOLING SPACES

BACKGROUND

The invention relates to a single-piece and two-piece piston of an internal combustion engine and to a method for producing such a piston.

In order to comply with emissions limits, or to achieve emissions targets and fuel consumption targets, combustion temperatures and combustion pressures are being raised to optimize combustion, as a result of which the upper part of the piston in particular is subjected to severe thermal loads. The operating temperature of the piston in these internal combustion engines can exceed the acceptable limits of the piston material, in conjunction with the risk of thermal aging in which the alloy of the piston material loses strength and dimensional stability. To minimize the thermal loads on the piston, pistons with an integral annular cooling channel are used, in which a small amount of the lubricating oil of the internal combustion engine is sprayed through an injector nozzle as coolant, which flows through the cooling channel and then exits. DE 197 500 021 A1 discloses a cooling channel piston that includes an annular cooling channel in the region of the ring area radially offset to a surface area. The coolant flowing through the cooling channel acts to dissipate heat, where the effectiveness of this liquid cooling is determined by the volumetric flow of the cooling medium through the cooling channel. With the increasing specific power output of the internal combustion engine, known concepts for liquid-cooled pistons have to be optimized. It is, therefore, necessary to apply coolant selectively to further areas of the piston, in addition to an annular cooling channel. In order to implement this measure, DE 41 18 400 A1 shows an assembled piston that includes cooling slots with walls running parallel to each other, the slots starting from the cooling channel and running in the direction of the piston head.

It would be desirable to optimize the cooling effect of the piston upper part of a single-piece and two-piece piston in thermally highly stressed zones using a cost-effective measure.

Using the prior art as a starting point, the present invention provides a piston upper part of a single-piece and two-piece piston with integrated recesses.

The two-piece piston is configured as a liquid-cooled piston, consisting of a piston lower part and a piston upper part having a combustion chamber recess. These piston components are supported by joining lands, spaced apart radially from one another and forming a dividing plane and joined together using a material-to-material fit, such as by means of a welded joint, or frictionally, by means of a screw connection. Thus, the joined piston is assembled from a piston upper part and a piston lower part, for example, by means of a screw connection, or welded together, for example, by means of a welded joint. An annular cooling channel is introduced into the piston upper part, extending into the piston lower part and connected to an inner cooling space by connecting channels. To enlarge the cooling space, the piston upper part includes recesses connected to the cooling channel, oriented in the direction of the piston head and configured as a blind hole.

It is also possible that the liquid-cooled piston of an internal combustion engine consists of a piston lower part and a piston upper part having a combustion chamber recess, where the piston is configured as a single-piece piston without a dividing plane.

To address the problem, the at least one recess emanating from the cooling channel and introduced circumferentially in the piston upper part is shaped such that its walls widen conically as they rise. Because of the resulting spreading out of the walls, a maximum cross-section is achieved in the areas of the greatest depth of the recess. While retaining specified wall thicknesses compared with previously known solutions, the invention enlarges the cooling space through which the coolant flows, being expanded at the bottom, and thus optimizes cooling of the piston upper part. One shape for the recess under the invention, spaced apart from a central contour, follows the tub-shaped combustion chamber recess in the piston head. In conjunction with a large-capacity space in the recess that increases the coolant intake, the "cocktail shaker" effect can be enhanced, and consequently the cooling effect can be augmented. The size and the extent of the recess that forms an expansion of the cooling channel is not limited by design specifications, for example, the location and arrangement of the dividing plane between the piston lower part and the piston upper part or the cooling channel, but can expand, for example, specifically in the direction of the combustion chamber recess. The recesses are intended for piston upper parts with a relatively small combustion chamber recess in order to cool the resulting large wall thicknesses and material accumulations in the piston head optimally. Coking to the point of burn-off and reduction in material strength can be avoided in this way. In conjunction with the measures to optimize cooling of the piston upper part, emissions requirements (Tier 3 and IMO) for assembled pistons with a small combustion chamber recess diameter can be met. The possibility exists of combining the piston upper part formed in accordance with the invention with existing proven piston lower parts. With a liquid-cooled piston configured as a single-piece piston of an internal combustion engine, the type of piston lower part and piston upper part is equally suitably shaped, as described previously.

In accordance with the invention, the size and extent of the recess is not restricted by the external diameter of the joining lands or of the supporting surfaces in the area of the dividing plane between the piston upper part and the piston lower part. Rather, the measure under the invention makes it possible to extend the recess intended for cooling as far as the thermally highly stressed zone. The cross-sectional profile in the recess bottom consequently exceeds the cross-sectional profile in the area where the recess passes into the cooling channel because of its conical widening. The piston head includes several recesses positioned distributed around the periphery and connected to the cooling channel. These recesses, configured as a blind hole, which selectively enlarge the cooling space, bring about improved, efficient cooling of the piston upper part. The recesses result at least locally in reduced wall thicknesses in the piston upper part, compared with the combustion chamber recess, the ring area, the upper land and the piston head. Contingent upon matching wall thicknesses between the recesses configured in accordance with the invention and the adjacent thermally severely stressed zones, a structurally strong piston upper part is realized that can meet the most severe demands.

The measure under the invention reduces component temperature to a level below the flame point of conventional cooling oils, simultaneously reducing the risk of coking for the lubricating oil of the internal combustion engine that is used as the coolant. In addition, there is no risk of an insulating oil carbon layer forming that reduces the cooling effect or of detrimental thermal piston deformation because of reduced strength in the piston material. Through the decisively improved heat dissipation and thus cooling effect of the recess under the invention, the piston upper part and consequently the entire piston can be used for higher combustion temperatures and compression pressures, i.e. in internal combustion engines with a high power density. In addition, the large-capacity shape of the recesses, which can be produced cost-effectively, reduce the weight of the piston upper part, particularly with small combustion chamber recess diameters.

One aspect of the recesses, which widen conically over their longitudinal extent, provides for the recesses to be shaped specifically as slots, drilled holes or channels distributed around the periphery in the piston upper part. Lands formed from the material of the piston upper part are provided between the recesses and the cooling channel. As an alternative to the lands, walls or supporting ribs can be used, where the walls or supporting ribs differ from the lands in their respective shape. To achieve high structural strength for the piston upper part, one solution is to configure the conically expanded recesses as torte-shaped cooling space chambers with a honeycomb structure that simultaneously has a positive effect on cooling properties and results in a greater cooling surface. In addition, the cooling space is expanded as a result.

In accordance with a further design aspect, the adjacent recesses are introduced opposite each other in the piston upper part alternately in geometric sizes that are identical to or differ from each other and/or inclinations to each other. This measure enables a selective extension of the recesses right into thermally highly stressed zones without the risk of weakening a component.

In accordance with a further aspect, the walls of the recess are oriented inclined at an angle of "$\alpha$, $\beta$" between 0° to 40°, preferably of ≤15° to a piston longitudinal axis, to achieve consistent wall thicknesses as far as possible with respect to the thermally highly stressed zones. Matched to the design construction of the piston head, a further possibility is to design the angle of inclination of oppositely located walls, in particular of an inner wall and an outer wall, to be consistent with one another or to diverge from one another.

For cost-optimized production and to prevent component weakening, provision is made to give the respective conically spreading recesses a rounded bottom that has a positive effect on structural strength. A radius "R" between 1.5 mm and D/2 (D=maximum diameter of the tool, for example a milling tool, used for the metal-cutting process for the rounded contour) is preferably used. As an alternative, it is possible to give the recess bottom a double-rounded contour, forming a dome-shaped, arched depression. In addition, to match the design construction of the piston head, the double-rounded recess bottom can have a stepped shape. The recess bottom can have a pronounced undulating surface, which produces an enlarged surface, or a finely undulating surface. Through additional machining steps in production, for example, milling cuts, the stepped transition between the curvatures is reduced, the result of which the surface of the curvature is qualitatively improved by reduced undulation on the surface and the size of the surface is reduced. It is thus possible by making a greater number of cuts to produce a finely undulating surface. As an alternative to a rounded final contour, a chamfered configuration for the recess bottom is provided. The recesses in the cooling channel additionally create increased swirl in the cooling channel. By adjusting the surface of the recess bottom and reducing the diameter of the recess bottom it is possible to reduce, or optimize, emissions during piston operation. Emissions during operation can also be reduced by modifying the stepped transition. By varying the depth of the recess, viewed from the piston lower part in the direction of the piston upper part, the cooling space can be adjusted to the shape of the depression in the combustion chamber recess. In the case of a single-piece piston, it is possible to adjust and design the recess bottom by means of the shape of the casting mold member, the shape of which is the negative of the shape of the recess bottom in specific areas.

A further of the invention provides for arranging the recesses, which are configured as channels, drilled holes or slots, symmetrically or asymmetrically around the periphery in the piston upper part. The position, orientation and size of the recesses can be adjusted to the different thermal loads. For example, it is possible to design the cooling space volume, or cross-sectional volume of the recess, on the pressure side differently compared with the cross-sectional volume on the counter-pressure side of the piston upper part. The location and design of the recess is located and designed in such a way that any material weakening in the piston upper part is avoided.

In accordance with a method under the invention, the following steps are followed to produce the recesses. First, a casting mold member, such as a salt core, matching the shape of the recesses is anchored in position in the casting mold intended for the piston upper part. After casting and chilling the piston upper part, the casting mold member is removed by purging.

In accordance with a further alternative method, the following steps are followed to produce the recesses for a single-piece piston. First, a casting mold member, such as a salt core, matching the shape of the recesses is anchored in position in the casting mold intended for the single-piece piston that has a piston upper part and a piston lower part. After casting and chilling the piston upper part, the casting mold member is removed by purging.

A further alternative method for producing the recesses provides for mechanical, three-dimensional machining work. Turning and milling work are preferably suitable by which cavities forming the recesses are introduced in the piston upper part. In addition, it is possible to produce the recesses by means of milling or using drilling tools.

BRIEF DESCRIPTION OF THE DRAWING

A piston upper part equipped in accordance with the invention, but to which the invention is not restricted, is described as an example in what follows and explained using the FIGS. in which.

DETAILED DESCRIPTION

Figure 1:
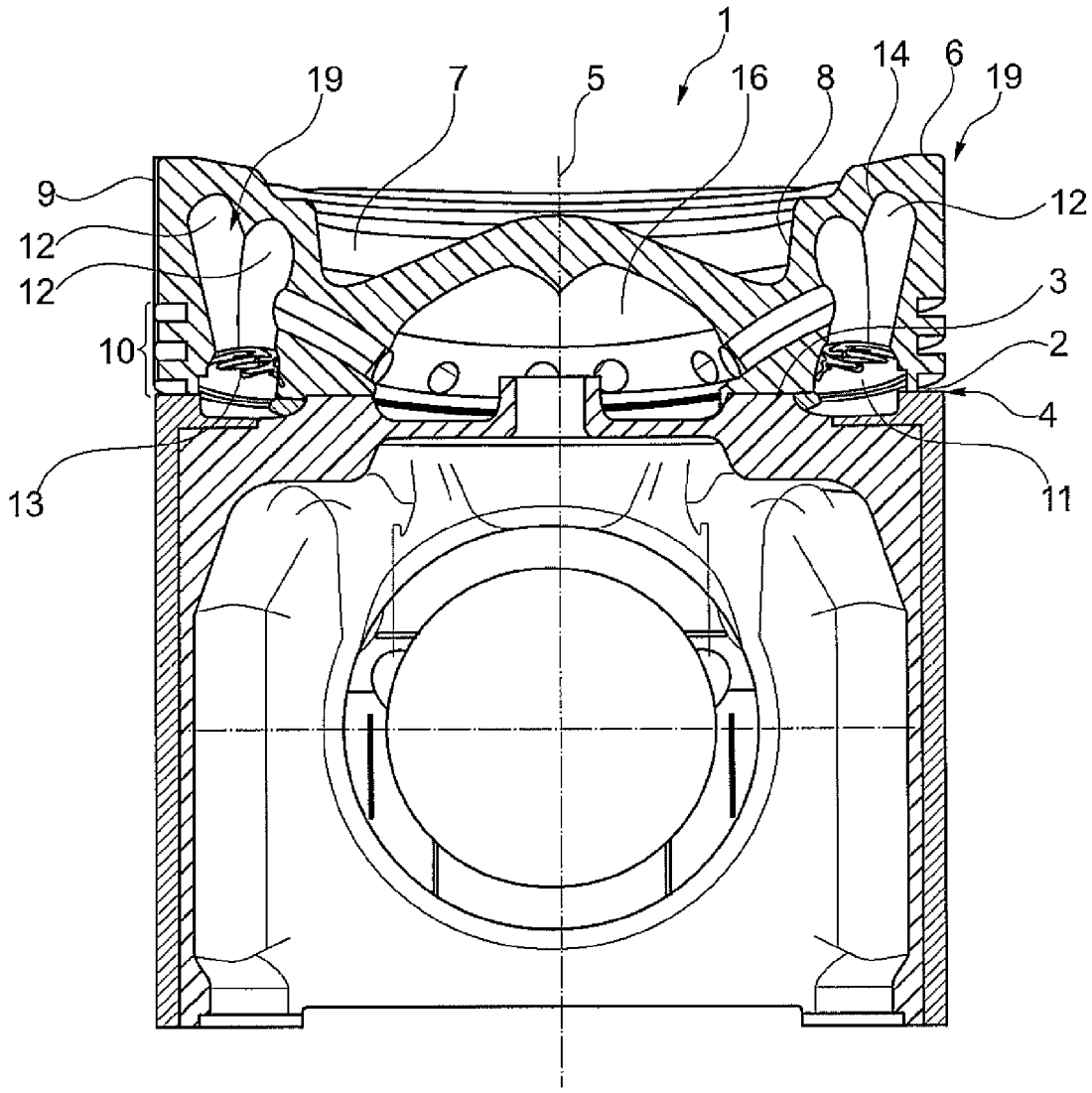
FIG. 1 shows a piston upper part in a longitudinal section with a recess shaped in accordance with the invention.

FIG. 1 shows a longitudinal section through a piston upper part 1, which is, for example, a component produced by means of a forging process from a steel alloy. Alternatively, the piston upper part 1 can be produced from aluminum, an aluminum alloy or an iron alloy. Alternatively, the piston upper part 1 can also be produced by any other forming process or primary shaping process. The piston upper part 1 forms jointly with a piston lower part, not shown in FIG. 1, a liquid-cooled, two-piece piston, for example, assembled frictionally or welded with a material-to-material fit. The piston upper part 1 is supported through two circumferential joining lands 2, 3, offset radially to each other, on corresponding joining lands on the piston lower part. All the joining lands jointly form a dividing plane 4, through which the piston lower part and the piston upper part 1 are permanently connected to each other by means of a frictional joint, by means of a screw connection, or by means of a material-to-material fit, such as by means of a welded joint. Secondly, the piston lower part and the piston upper part 1 lie on top of each other in a positive fit by means of the dividing plane 4. A combustion chamber recess 7 is formed in a piston head 6 of the piston upper part 1 concentrically to a piston longitudinal axis 5, which recess is bounded on its outer side by a stepped edge 8. The piston upper part 1 is surrounded by a top land 6 adjoining the piston head 6, said top land adjoining a ring area 10 intended to receive piston rings. An annular cooling channel 11 is provided in the area of the dividing plane 4 to cool the piston upper part 1. The channel extends as far as the piston lower part, and coolant, such as, lubricating oil of the internal combustion engine, circulates through the channel when the internal combustion engine is operating. For this purpose, the cooling medium enters the coolant channel through an inlet and leaves the cooling channel via several connecting channels 15, also known as transfer drillings, by way of an outlet. The coolant feed can alternatively take place through the piston center, that is to say, the inner cooling space 16. For this, the coolant is taken through the connecting channels 15 into the cooling channel 11 and then drains out of the cooling channel 11 through return holes. The cooling channel 11 is connected to several recesses 12 distributed around the perimeter and oriented in the direction of the piston head 6. These recesses 12, located around the perimeter and inserted as blind holes, are configured as channels, drilled holes and/or slots and enlarge the cooling space in the piston upper part 1 contacted by the coolant. To ensure adequate rigidity in the piston head 1, lands 13 are provided in a transition area between the cooling channel and the recesses 12. Starting from the cooling channel 11, the recesses 12 expand conically to a maximum at a recess bottom 14. The recesses 12 are connected to a central inner cooling space 16 positioned below the combustion chamber recess 7 through connecting channels 15 positioned on the perimeter side.

Figure 2:
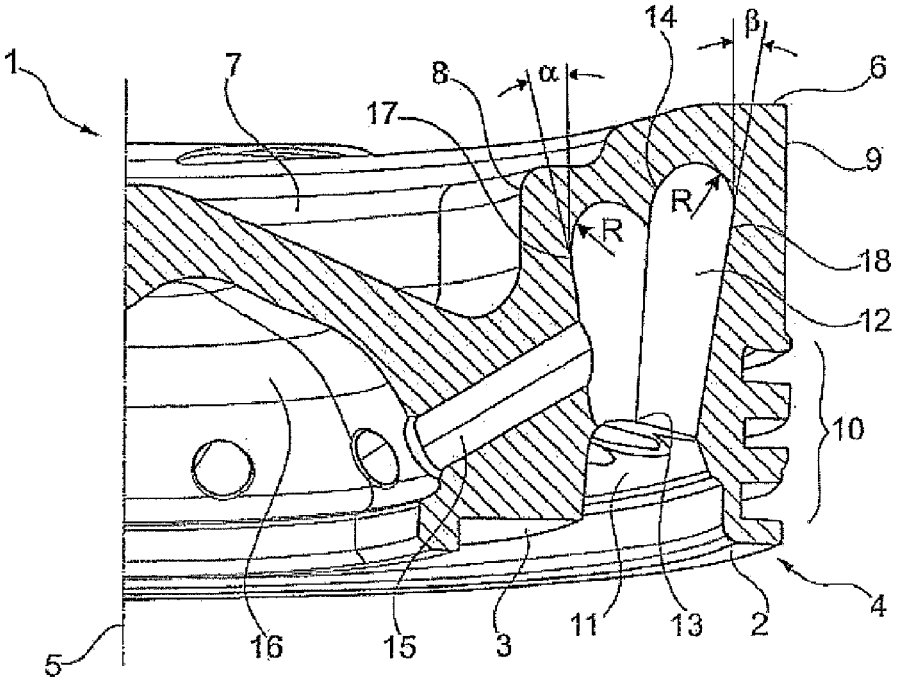
FIG. 2 shows a detail of the piston upper part from FIG. 1 on an enlarged scale.

FIG. 2 clarifies the geometric shape of the recess 12 in an enlarged illustration. The introduced recesses 12 distributed around the perimeter can alternatively be shaped as cavities running for a limited distance around the perimeter. The recess 12 is created subsequently during production by forging by means of mechanical, three-dimensional machining in the piston upper part 1 in accordance with the embodiment. In the case of a piston upper part 1 produced by a casting process, there is an alternative possibility of forming the recess 12 into the piston upper part 1 by means of a casting mold member. To achieve wall thicknesses matching the outer contours of the piston upper part to the greatest extent, for example, the piston head 6, the top land 9 and the edge 8 of the combustion chamber recess 7, the recess 12 has a stepped bottom 14. The dome-shaped recess bottom 14, which forms an arched depression, comprises a double-rounded contour including the radius "R." The depth of the recess bottom located between the radii "R" can be adjusted in the recess 12 by the number of cuts. Specifically to match the design construction of the piston upper part 1 and of almost matching wall thicknesses opposite the thermally highly stressed zones, the inner wall 17 of the recess 12 lying closer to the piston longitudinal axis 5 in the radial direction and the outer wall 18 of the recess 12 lying farther away from the piston longitudinal axis in the radial direction are respectively inclined to the piston longitudinal axis 5. The angle of inclination a of the inner wall 17 and the angle of inclination P of the outer wall 18, where the inner wall 17 and the outer wall 18 are inclined in opposite directions to each other, can be the same or diverge from each other.

Figure 3:
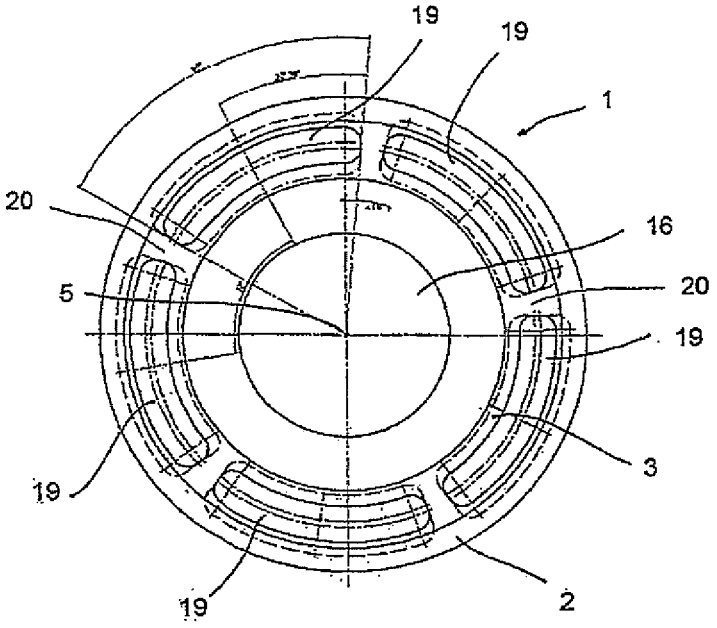
FIG. 3 shows a plan view of a piston upper part with several slot-shaped recesses.

A further aspect of a piston upper part 1 is depicted in FIG. 3. Identical components are given the same reference numerals, and new components are identified with new reference numerals.

FIG. 3 shows the plan view of the piston upper part 1 of a two-piece piston in the direction of the two joining lands 2, 3. The piston upper part has several slot-shaped recesses 19 with a specific radius, arranged tangentially around the piston longitudinal axis 5, in the example five slot-shaped recesses 19 in accordance with FIG. 3. Tangential distribution around the piston longitudinal axis 5 is also known by the term radial distribution around the piston longitudinal axis 5. An alternative possibility is for the piston upper part to have more than five or fewer than five slot-shaped recesses 19.

The inner cooling space 16, around which the five slot-shaped recesses 19 are arranged distributed around the periphery, is also depicted in FIG. 3 for clarification. The slot-shaped recesses 19 are not connected to each other so that in each case a separation exists between the respective slot-shaped recesses 19 in the form of lands 20.

Figure 4:
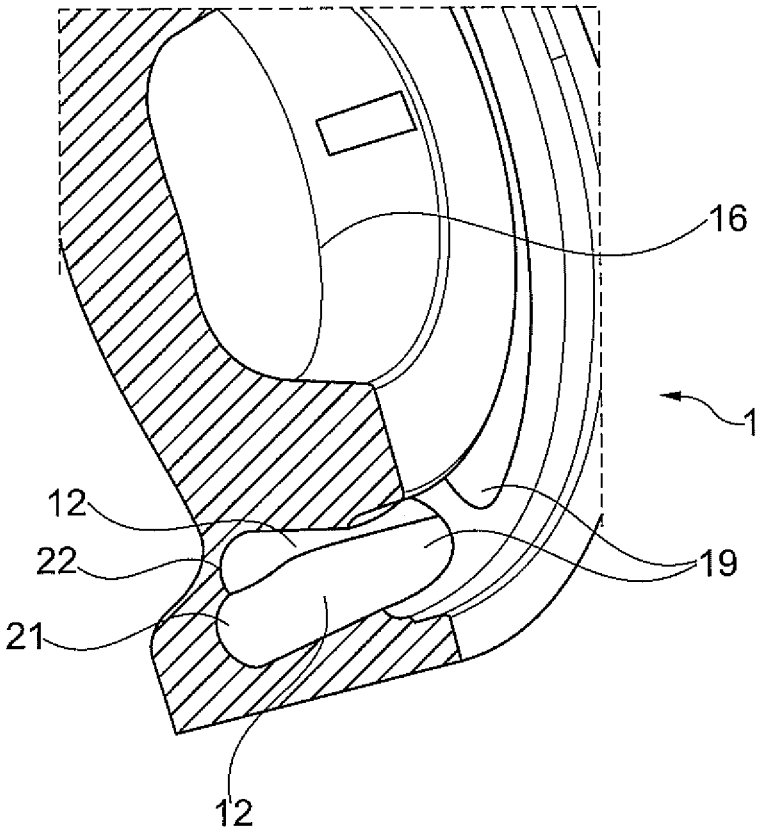
FIG. 4 shows a spatial rendering of cooling slots in a piston upper part.

Two cooling slots 21, 22 with undulating cooling in a piston upper part 1 of a two-piece piston are shown in FIG. 4, where the two cooling slots 21, 22 are assigned to the recess 12 shown. It is possible to reduce further the cavity diameter of the respective cooling slots 21, 22 or to introduce a stepped lip. Undulating cooling has the effect of enlarging the cooling surface and creating swirl. The inner cooling space 16 is also shown in FIG. 4 for clarification.

Figure 5:
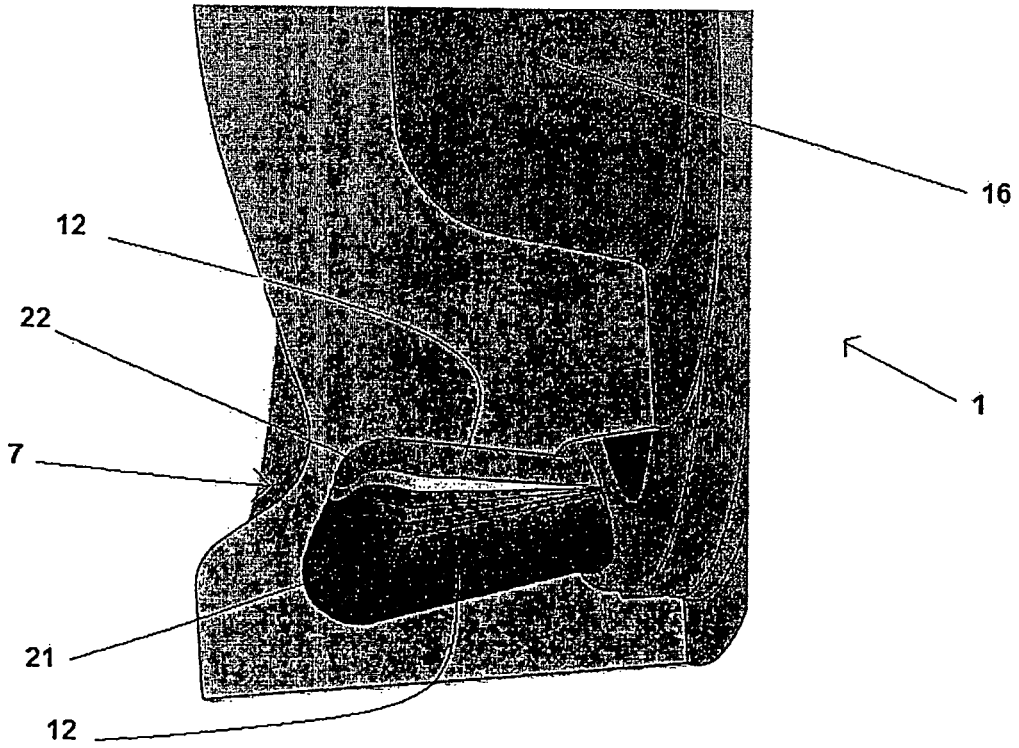
FIG. 5 shows a spatial rendering of a piston upper part with expanded cooling slots.

Two enlarged cooling slots 21, 22 with a smoothed surface are shown in FIG. 5, where the two cooling slots 21, 22 are assigned to the recess 12 shown. It is possible to reduce the cavity diameter further or machine the stepped edge that is used to reduce emissions.

By varying the depth of the respective cooling slots 21, 22 of the recess 12, it is possible that the cooling space is matched to the hollowed out shape of the combustion chamber recess 7. The degree of smoothing is achieved by the number of slots between cooling slot 21 and cooling slot 22. The inner cooling space 16 is added in FIG. 5 for clarification.

What is claimed:

1. A piston of an internal combustion engine configured as a liquid-cooled piston, comprising:

a piston lower part and a piston upper part having a combustion chamber recess supported and joined together by joining lands spaced apart radially from each other and forming a dividing plane;

in the piston upper part an annular cooling channel extending as far as the piston lower part and connected by connecting channels to an inner cooling space and having recesses configured as blind holes oriented in the direction of a piston head and forming cooling spaces, the recesses widening conically, starting from the cooling channel toward the piston head as far as a recess bottom of the respective recess.

2. The piston from claim 1, wherein the piston upper part and the piston lower part are joined together with a material-to-material fit.

3. The piston from claim 2 wherein:

the piston upper part and the piston lower part are joined together in a material-to-material fit by means of one of a welded joint, frictionally and by a screw connection.

4. The piston from claim 1, wherein the recesses introduced and distributed around the periphery of the piston upper part are configured conically as the recesses rise toward the piston head.

5. The piston from claim 4 wherein:

the recesses are formed as one of drill holes, channels and slots.

6. The piston from claim 1, wherein lands formed from a material of the piston upper part are provided between the recesses and the cooling channel.

7. The piston from claim 1, wherein the recesses form a honeycomb structure.

8. The piston from claim 1, wherein adjacent recesses introduced in the piston upper part are inclined alternately radially inward and radially outward from the cooling channel toward the piston head.

9. The piston from claim 1, wherein the recesses have oppositely inclined walls, including an inner wall and an outer wall, the angle of inclination of the inner wall and the outer wall being between 0° to 40°, the angles either coinciding with or diverging from each other.

10. The piston from claim 1, wherein the recesses have one of a rounded and a chamfered recess bottom with a radius between 1.5 mm and D/2.

11. The piston from claim 1, wherein the recesses include one of a double-rounded and a stepped rounded recess bottom.

12. The piston from claim 1, wherein the conically widened recesses, are integrated one of symmetrically and asymmetrically on the periphery side.

13. A piston of an internal combustion engine configured as a single-piece, liquid cooled-piston, with a piston lower part and a piston upper part having a combustion chamber recess comprising:

In the piston upper part an annular cooling channel connected by connecting channels to an inner cooling space, and having recesses configured as blind holes oriented in the direction of a piston head and forming cooling spaces; and the recesses widening conically, starting from the cooling channel, toward the piston head as far as a recess bottom of the respective recess.

14. A method for producing a piston upper part of a liquid-cooled piston of an internal combustion engine that is joined to a piston lower part, wherein the piston upper part has a combustion chamber recess and a cooling channel that is connected to a central inner cooling space and also connected to a plurality of recesses oriented in the direction of and widening conically toward a piston head and configured as blind holes, comprising;

inserting a casting mold member matching the shape of the plurality of recesses in a mold intended for the piston upper part prior to a casting process; and following completion of the casting and chilling of the piston upper part removing the casting mold member by purging.

15. The method from claim 14, comprising:

joining the piston upper part and the piston lower part together by a material-to-material fit.

16. The method from claim 15 further comprising the step of:

creating the material-to-material fit by means of one of a welded joint, frictionally, and by a screw connection.

17. A method for producing a single-piece, liquid-cooled piston of an internal combustion engine having a piston upper part and a piston lower part, wherein the piston upper part has a combustion chamber recess and a cooling channel that is connected to a central inner cooling space and also connected to a plurality of recesses oriented in the direction of and widening conically toward a piston head configured as blind holes, comprising:

inserting a casting mold member matching the shape of the plurality of recesses in a mold intended for the piston upper part prior to a casting process; and following completion of the casting and chilling of the piston upper part removing the casting mold member by purging.

18. A method for producing a piston upper part of a liquid-cooled piston of an internal combustion engine that is joined together with a piston lower part, wherein the piston upper part has a combustion chamber recess and a cooling channel that is connected to a central inner cooling space and also connected to a plurality of recesses oriented in the direction of and widening conically toward a piston head and configured as blind holes comprising:

forming the recesses in the piston upper part by means of mechanical, three-dimensional machining.

19. The method from claim 18, comprising:

producing the piston upper part by means of a forming process before the recesses are introduced.

20. The method from claim 19 wherein:

the forming process is a forging process.

* * * * *